US008341982B2

(12) United States Patent
Lee et al.

(10) Patent No.: US 8,341,982 B2
(45) Date of Patent: Jan. 1, 2013

(54) DETERGENT SUPPLY APPARATUS AND WASHING MACHINE

(75) Inventors: Jong Min Lee, Seoul (KR); Young Ho Kim, Seoul (KR); Jae Hyun Kim, Seoul (KR); Sang Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 228 days.

(21) Appl. No.: 12/453,839

(22) Filed: May 22, 2009

(65) Prior Publication Data

US 2009/0293556 A1 Dec. 3, 2009

(30) Foreign Application Priority Data

May 23, 2008 (KR) ..... 10-2008-0048191

(51) Int. Cl.
*D06F 35/00* (2006.01)
*D06F 31/00* (2006.01)

(52) U.S. Cl. ..... 68/17 R; 68/3 R

(58) Field of Classification Search ..... 68/17 R
See application file for complete search history.

(56) References Cited

U.S. PATENT DOCUMENTS

| | | | | |
|---|---|---|---|---|
| 3,826,408 | A | 7/1974 | Berndt et al. | |
| 4,162,747 | A * | 7/1979 | Graf | 222/484 |
| 5,542,586 | A * | 8/1996 | Stockwell | 222/538 |
| 5,870,906 | A | 2/1999 | Denisar | |
| 2006/0081016 | A1 * | 4/2006 | Hsu et al. | 68/12.18 |
| 2006/0107705 | A1 * | 5/2006 | Hsu et al. | 68/17 R |

FOREIGN PATENT DOCUMENTS

| | | |
|---|---|---|
| EP | 0 268 451 | 5/1988 |
| EP | 0 423 044 | 4/1991 |
| JP | 63-012385 | 1/1988 |
| KR | 10-2003-0004716 | 1/2003 |
| WO | WO 2006/073885 | 7/2006 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

A washing machine according to an exemplary embodiment of the invention includes a body having a washing tub; a detergent bottle seating part provided over the body and having a detergent inlet through which a liquid detergent is entered, a detachable detergent bottle containing the liquid detergent being seated on the detergent bottle seating part; and a detergent storing part provided under the detergent bottle seating part, the liquid detergent contained in the detergent bottle being entered and stored in the detergent storing part by its weight.

19 Claims, 9 Drawing Sheets

DETERGENT SUPPLY APPARATUS AND WASHING MACHINE

This application claims the benefit of Korean Patent Application No. 10-2008-0048191, filed on May 23, 2008, which is hereby incorporated by reference for all purposes as if fully set forth herein.

BACKGROUND

The embodiments of the invention relate to a detergent supply apparatus and a washing machine, and more specifically to a detergent supply apparatus and a washing machine that may automatically supply a liquid detergent.

In general, a washing machine is an appliance that cleans laundry by washing, rinsing, and dehydrating the laundry removing dirt and odors on clothes, bedclothes and the like (hereinafter, referred to as laundry) using water, detergent, and mechanical operation.

The washing machine includes a washing tub that is rotatably arranged in the washing machine and accommodates water and laundry, and a driving apparatus that rotates the washing tub to wash the laundry. The washing machine further includes a water supply apparatus that supplies water into the washing tub and a water discharge apparatus that discharges the water from the washing tub to the outside. A detergent supply apparatus is arranged over the water supply fluid passage of the water supply apparatus to supply a detergent to the inside of the washing tub. The detergent supply apparatus includes a dispenser in fluid communication with the washing tub and arranged over the water supply fluid passage and a detergent box that is arranged to be removable from the dispenser and accommodate various detergents.

In a conventional washing machine the detergent box is withdrawn from the dispenser each time the washing machine is run. A powder or liquid-type detergent is supplied in the detergent box, and then the detergent box is inserted back to the inside of the dispenser. At this time, when the water supply apparatus operates, the powder or liquid-type detergent in the detergent box is supplied into the inside of the washing tub along with water flowing through the water supply fluid passage of the water supply apparatus.

Conventional washing machines have the disadvantage that detergent must be manually supplied into the detergent box each time the washing machine is run. This is tedious and inconvenient for the user of the washing machine. Furthermore, the amount of detergent supplied in the detergent box is intuitively determined by the user. Therefore, too much or too little detergent may be supplied, which may give rise to over or under consumption of the detergent, thus lowering washing capacity and/or increasing detergent costs to the user.

SUMMARY

The exemplary embodiments of the invention are set forth to obviate the above disadvantages in the prior art. An advantage of the embodiments of the invention is to provide a detergent supply apparatus and a washing machine that seats a detergent bottle containing a liquid detergent on the washing machine so that the liquid detergent may be supplied by button operations.

Another advantage of the embodiments of the invention is to provide a detergent supply apparatus and a washing machine that may supply a predetermined amount of liquid detergent.

Still another advantage of the embodiments of the invention is to provide a detergent supply apparatus and a washing machine that may readily incorporate a commercially available detergent bottle containing a liquid detergent.

The object of the embodiments of the invention is not limited to the above ones, and other objects not referred to may be apparently understood by those skilled in the art from the below descriptions.

A detergent supply apparatus according to an exemplary embodiment of the invention include a detergent bottle seating part provided over a body in which washing is performed and having a detergent inlet through which a liquid detergent is entered, a detachable detergent bottle containing the liquid detergent being placed on the detergent bottle seating part; and a detergent storing part provided under the detergent bottle seating part, the liquid detergent contained in the detergent bottle being entered and stored in the detergent storing part due to its weight and the force of gravity.

A washing machine according to an exemplary embodiment of the invention include a body having a washing tub; a detergent bottle seating part provided over the body and having a detergent inlet through which a liquid detergent is entered, a detachable detergent bottle containing the liquid detergent being seated on the detergent bottle seating part; and a detergent storing part provided under the detergent bottle seating part, the liquid detergent contained in the detergent bottle being entered and stored in the detergent storing part by its weight.

The detergent supply apparatus and washing machine according to the embodiments of the invention have the effects as follows:

Firstly, there is an advantage that one may place a detergent bottle containing a liquid detergent on the washing machine and supply the liquid detergent by button operations.

Secondly, there is an advantage that one may readily utilize a commercially available detergent bottle containing a liquid detergent without modification to the commercial detergent bottle.

Finally, there is an advantage that one may supply a predetermined amount liquid detergent into the washing machine.

The effects of the embodiments of the invention are not limited to the above ones and other effects not referred to may be apparently understood by those skilled in the art from the accompanying claims.

DETAILED DESCRIPTION

Figure 1:
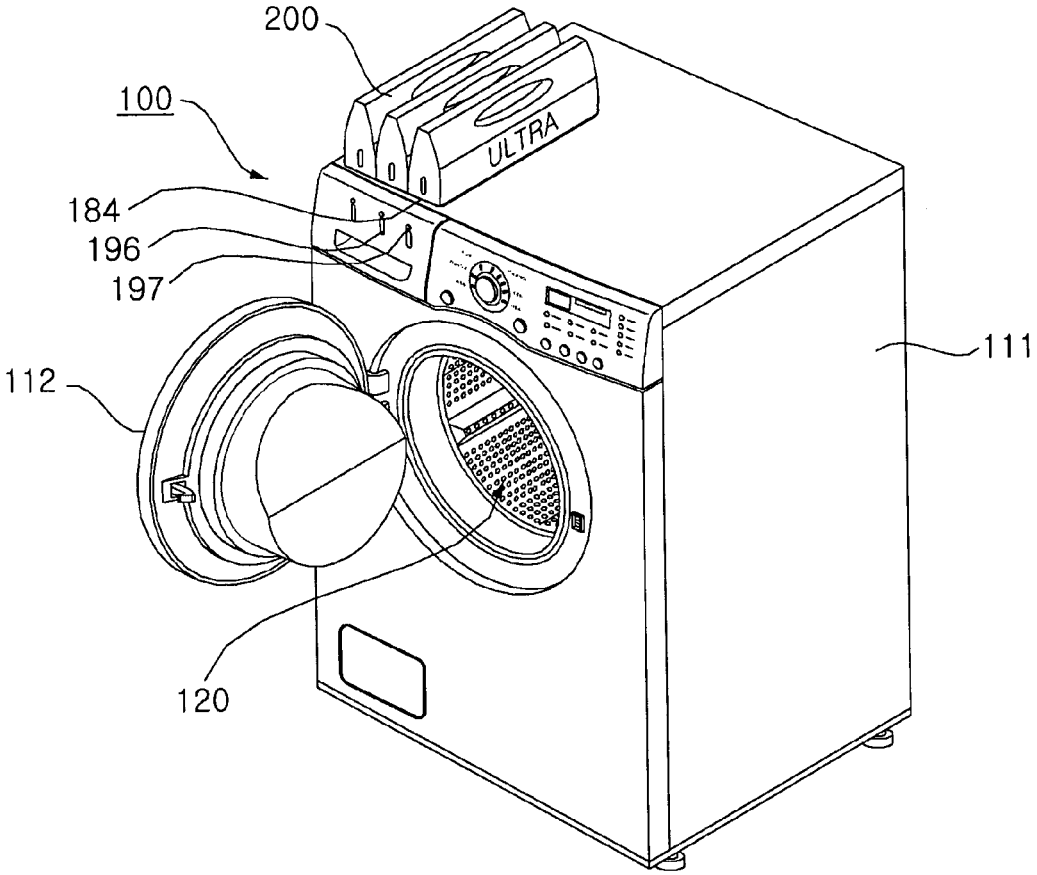
FIG. 1 is a perspective view illustrating a washing machine according to an exemplary embodiment of the invention.
Figure 1:
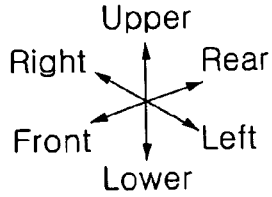

The advantages and features of the exemplary embodiments of the invention and methods of achieving them will become apparent in the foregoing detailed description with reference to accompanying drawings. However, it should be noted that the disclosure is not limited to the following exemplary embodiments, and may be implemented in various forms. Accordingly, the exemplary embodiments are set forth to provide a more complete disclosure and let those skilled in the art know the category of the disclosure. The scope of the disclosure is defined by accompanying claims. Throughout the specification, the same reference numerals refer to the same elements.

Hereinafter, the disclosure will be described by its exemplary embodiments with reference to accompanying drawings that illustrate a detergent supply apparatus and a washing machine.

Figure 2:
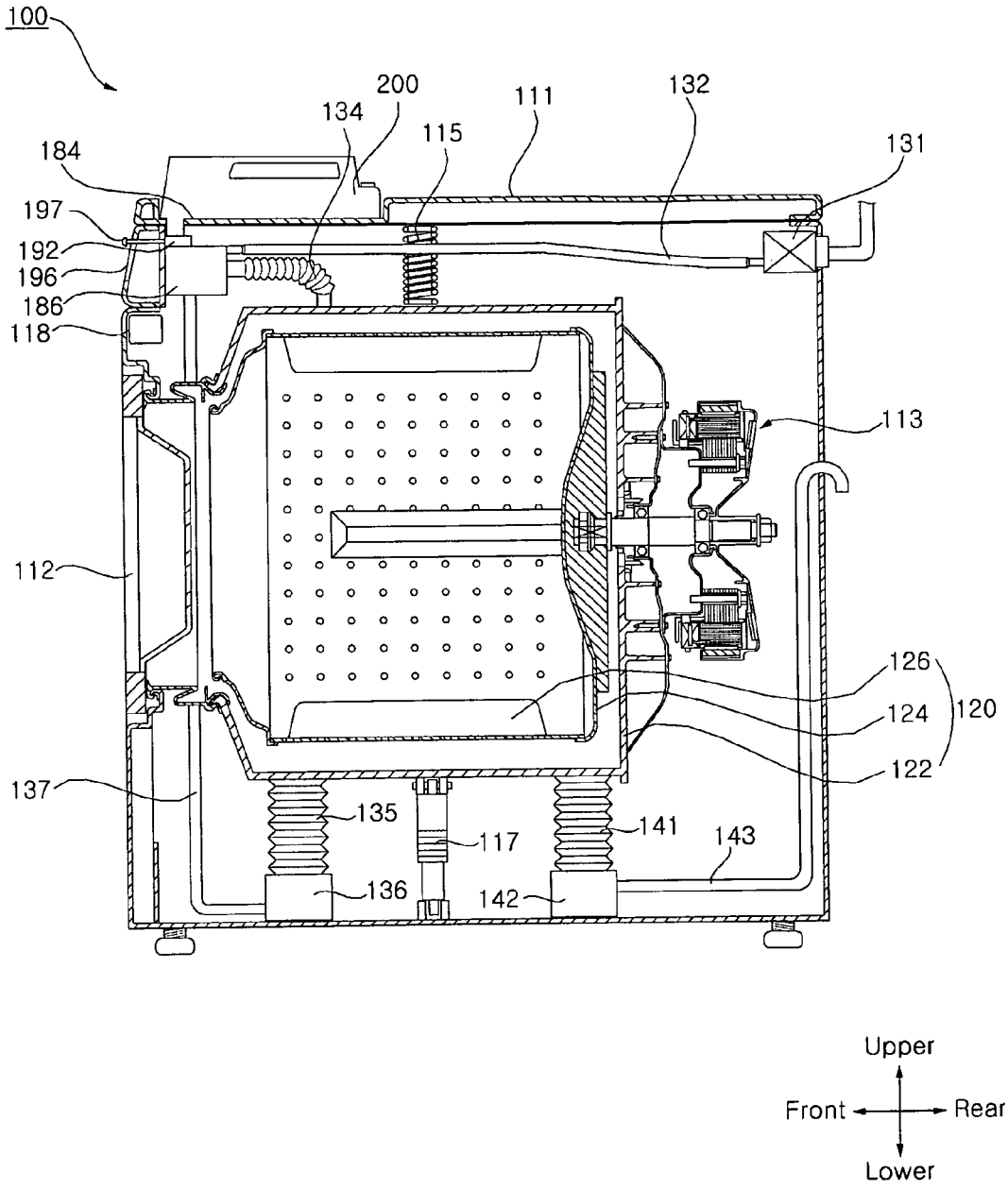
FIG. 2 is a side cross sectional view of the washing machine shown in FIG. 1.
Figure 3:
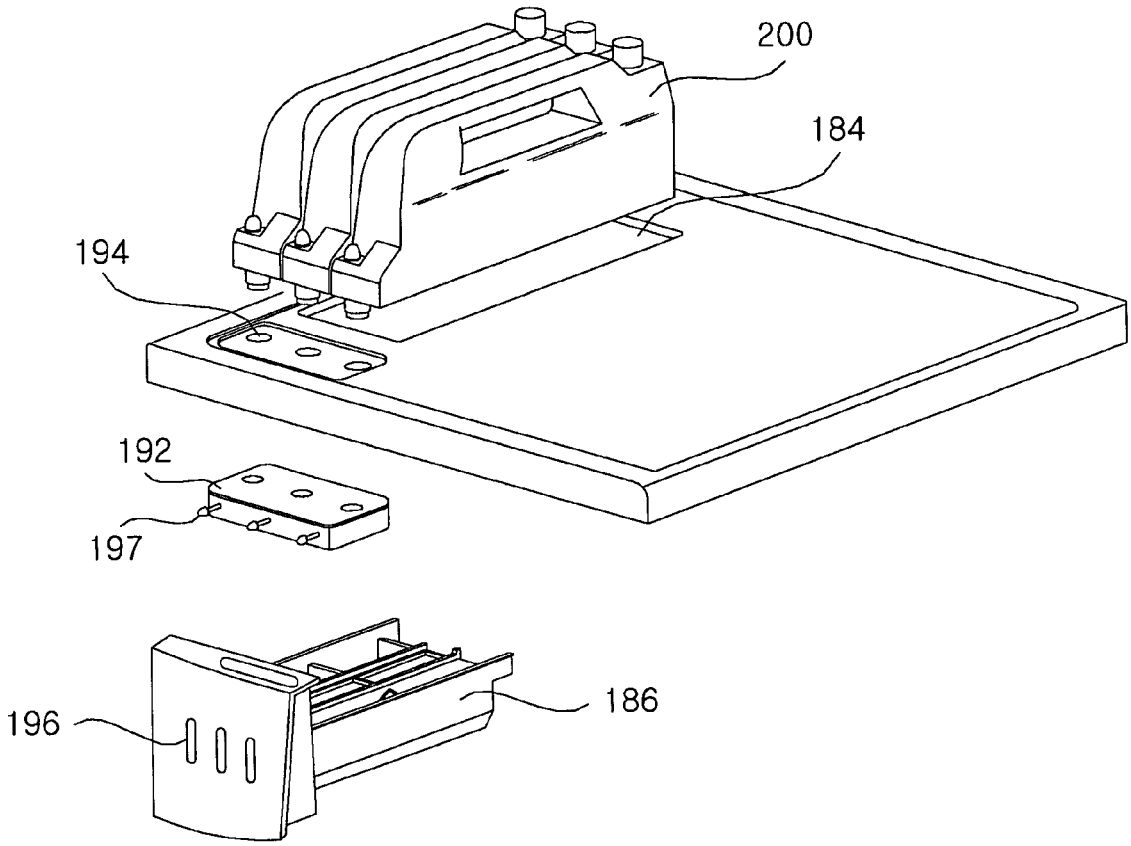
FIG. 3 is a partially exploded perspective view of the liquid detergent delivery system shown in FIG. 1.

FIG. 1 is a perspective view illustrating a washing machine according to an exemplary embodiment of the invention, FIG. 2 is a side cross sectional view of the washing machine shown in FIG. 1, and FIG. 3 is a partially exploded perspective view of the liquid detergent delivery system in FIG. 1.

The washing machine 100 according to an exemplary embodiment of the invention includes a body 111 having a washing tub 120, a detergent bottle seat 184 provided above the body 111 so that a detachable detergent bottle 200 containing a liquid detergent is seated on the detergent bottle seat 184, and a detergent mixing part 186 provided under the detergent bottle seating part 184. The detergent bottle seat 184 has a detergent inlet 194 through which the liquid detergent enters. The liquid detergent stored in the detergent bottle enters and is stored in the detergent mixing part 186 due to its weight and the force of gravity. A controller 118 may also be included to control the functioning of the washing machine.

The washing tub 120 accommodates laundry, liquid detergent, and water therein for washing. The washing tub 120 is arranged to be shock absorbent in the inside of the body 111 by a spring 115 and a damper 117. The washing tub 120 preferably includes a tub 122 that accommodates washing water and liquid detergent therein, a drum 124 rotatably arranged inside the tub 122 to accommodate the laundry therein and having a plurality of apertures through which the washing water and liquid detergent in the tub 122 may pass, and a lifter 126 arranged on the inner surface of the drum 124 to lift and drop the laundry at a predetermined height while the drum 124 rotates. During a spinning cycle a rotational force is applied to the drum 124 from a driving part 113 that is provided on the inside of the body 111.

As illustrated in FIG. 2, it is preferable that a washing water supply valve 131, a washing water supply fluid pipe 132, and a mixing part 186 are provided on the inside of the case 111. The washing water supply valve 131 may supply washing water from an external water source, and the washing water flows through the washing water supply fluid pipe 132 and the washing water supply valve 131 into the mixing part 186. The mixing part 186 mixes the washing water with a liquid detergent, and the mixed water and detergent may flow into the tub 122 via a water delivery passage 134.

Furthermore, it is preferable that a circulation tube 135, a circulation pump 136, and a circulation fluid tube 137 are provided in the case 111. The circulation tube 135 provides a passage for the washing water and liquid detergent to exit the tub 122 to be circulated by the circulation pump 136. The circulation fluid tube 137 provides a passage for the washing water and liquid detergent to flow into the mixing part 186.

It is also preferable that a water discharge tube 141, a water discharge pump 142, and a water discharge fluid passage 143 are provided in the case 111. The water discharge tube 141 provides a passage for the used washing water and liquid detergent to exit and be discharged from the tub 122 as it is pumped by the water discharge pump 142. The water discharge fluid passage 143 then provides a passage for the washing water and liquid detergent to be discharged outside the washing machine 100.

It is understood that the structure and arrangement inside the washing tub 120 and the case 111 described above may be altered by those skilled in the art.

As illustrated in FIGS. 2 and 3, the detergent bottle seat 184 on which the detachable detergent bottle 200 may be seated is provided over the body 111, and has a detergent inlets 194 through which the liquid detergent may enter. Preferably, the detergent bottle seat 184 may be formed so that plural detergent bottles that contain a liquid detergent for washing, a liquid detergent for rinsing (fabric softener), and a liquid detergent for bleaching, may be seated on the detergent bottle seating part 184, and the detergent bottle seating part 184 may preferably have plural detergent inlets 194. Three detergent inlets are provided in the exemplary embodiment of the invention, however, any number of detergent inlets are envisioned and within the scope of the invention. The detergent bottle seating part 184 is preferably formed to fit for the shape of a side surface of the detergent bottle 200, and the detergent bottle seating part 184 may be formed of an elastic member that may be deformable depending on the shape of the detergent bottle 200. Various implementing methods of the detergent bottle seating part 184 will be described later with reference to FIGS. 8 and 9.

The detergent bottle 200 may be detachable. Any commercially available detergent bottle containing a liquid detergent may readily be used herein without modification or the liquid detergent may be stored in a detergent bottle that may be provided with the washing machine upon use. Examples of commercially available detergent bottles include, but are not limited to those manufactured by P&G®.

The detergent mixing part 186 may be provided under the detergent bottle seat 184 to store and/or mix the liquid detergent. The detergent mixing part 186 may be provided over the washing tub 120 in the body 111. The detergent mixing part 186 is preferably connected to the washing water supply pipe 132, the water supply fluid passage 134, and the circulation tube 137 so that the stored liquid detergent may be mixed with the washing water. The detergent mixing part 186 may preferably be partitioned into plural sections so that various types of liquid detergents may be stored, mixed, and introduced to the tub 120 independently from each other. In the alternative the detergent mixing part 186 may be one large section or a chamber fluidly connected to three detergent bottles in the case where one type of detergent is used. The detergent mixing part 186 is illustrated as being partitioned into three sections in the exemplary embodiment of the invention.

The detergent mixing part 186 may include an indicator 196 that allows a user to observe and check the amount of the stored liquid detergent. The indicator 196 may be implemented in various ways. For example, the indicator 196 may be implemented as a window through which the stored liquid detergent may be viewed from the outside of the body 111. The indicator may also be in the form of an LED or LCD screen to notify the user of the liquid detergent levels.

A flow guide 192 may have plural detergent fluid passages 318 so that each of the liquid detergents contained in the plural detergent bottles may be separately supplied from each of the plural detergent inlets 194 to each of the plural sections of the detergent mixing part 186. In a case where the plural detergent bottles 200 are used, plural detergent inlets 194 are provided, and the detergent mixing part 186 is thus partitioned into the plural sections. The flow guide 192 is preferably provided between the detergent mixing part 186 and the detergent inlet 194 of the detergent bottle seat 184. The flow guide 192 may be omitted depending on the construction of the detergent mixing part 186 and the detergent bottle seating part 184. The detailed structure of the fluid passage guide 192 will be described later with reference to FIGS. 4 and 5.

The flow guide 192 may have a detergent supply button 197 that opens and closes a detergent fluid passage 318. The detergent supply button 197 opens and closes the detergent fluid passage 318 of the fluid passage guide 192 to control the inflow of the liquid detergent from the detergent bottle 200 into the detergent mixing part 186. The detergent supply button 197 may be provided at the detergent bottle seat 184 to open and close the detergent inlet of the detergent bottle seat 184 according to an exemplary embodiment, or may be provided at the detergent bottle 200 itself.

Figure 4:
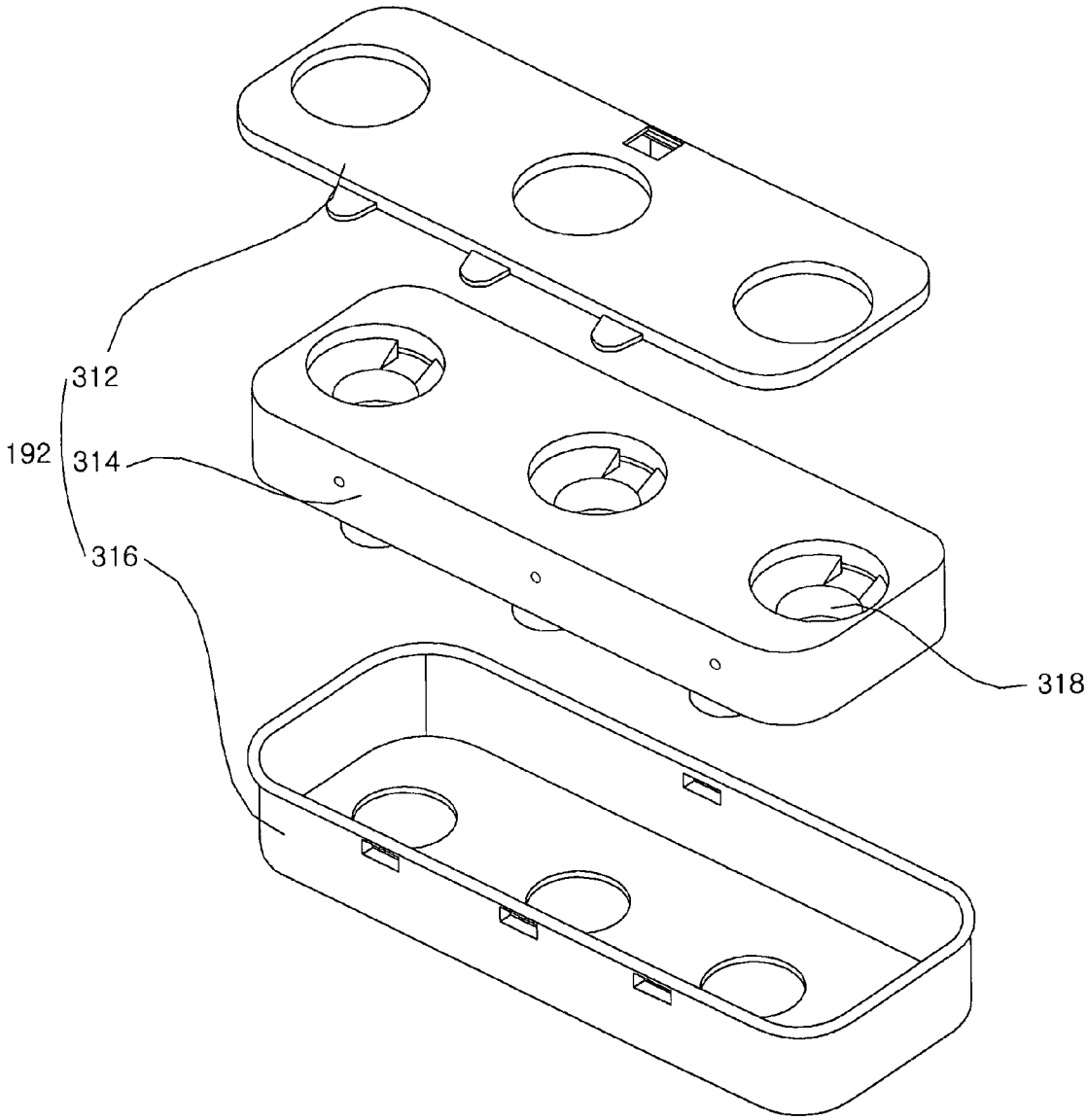
FIG. 4 is an exploded perspective view illustrating a fluid passage guide included in a washing machine according to an exemplary embodiment of the invention.
Figure 5:
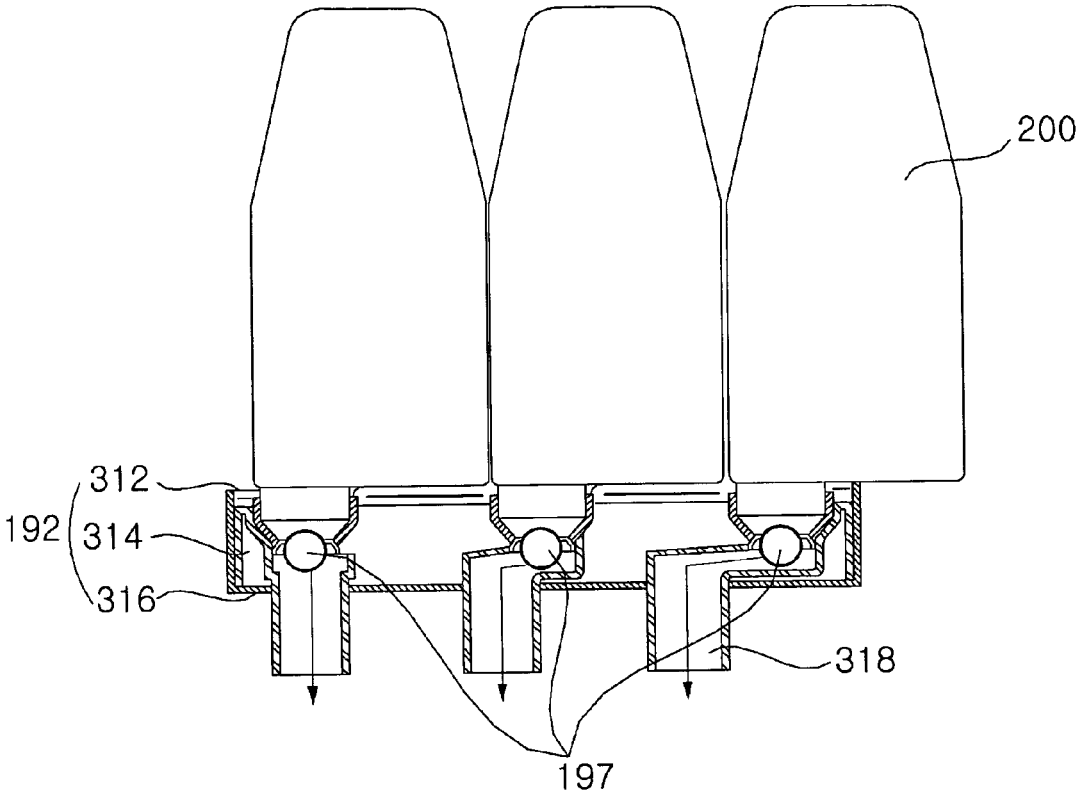
FIG. 5 is a construction view of the fluid passage guide shown in FIG. 4.

FIG. 4 is an exploded perspective view of the flow guide 192 included in a washing machine according to an exemplary embodiment of the invention, and FIG. 5 is a perspective view of the flow guide shown in FIG. 4.

The flow guide 192 includes a flow guide upper plate 312, a flow guide case 316, and an inner frame 314 having the detergent fluid passage 318. The flow guide upper plate 312 and the flow guide case 316 form the external appearance of the flow guide 192. The flow guide upper plate 312 has plural holes in compliance with the detergent inlet 194, and may be combined with the detergent bottle seat 184. The flow guide case 316 may be combined with the detergent mixing part 186.

The detergent fluid passage 318 of the inner frame 314 may be formed having a broad width adjacent to upper plate 312 and narrowing to a smaller width adjacent to a bottom of the flow guide case 316. This form acts to funnel the liquid detergent to flow through the detergent inlet 194 and into the partitioned section of the detergent mixing part 186. The detergent fluid passage 318 may be formed in a horizontal orientation or diagonal direction as well as in the vertical direction. The inner frame 314 preferably has the detergent supply button 197 for opening and closing the detergent fluid passage 318. The detergent supply button 197 may be implemented in various ways. For example, the detergent supply button 197 may be implemented as a push button valve as illustrated in the exemplary embodiment of the invention.

An operation of the washing machine according to the exemplary embodiment of the invention as discussed above will be described as follows.

A user places the detergent bottle 200 on the detergent bottle seat 184. If the detergent bottle 200 has been seated on the detergent bottle seat 184, this process would be omitted.

The user opens the door 112 to put laundry in the drum 124 of the washing tub 120. When the user presses the detergent supply button 197, the liquid detergent in the detergent bottle 200 enters and is stored in the detergent mixing part 186 via the flow guide 192 due to its weight and the force of gravity. The user checks the amount of the dispensed liquid detergent through the indicator 196 and adjusts the amount of the liquid detergent depending on the concentration of detergent and/or the amount or type of laundry. When plural detergent bottles 200 are provided, the user appropriately supplies the liquid detergent for washing, the fabric softener or liquid detergent for rinsing, and the liquid detergent for bleaching to the detergent mixing part 186.

When the user runs the washing machine 100, the washing machine 100 senses the amount of laundry placed in the drum 124 and sets the level of water supply, the washing time, and the like according to the amount of laundry.

When the washing water supply valve 131 is opened and a predetermined amount of washing water is supplied from an external water source upon initiation of a washing process, the washing water passes through the washing water supply pipe 132 to be mixed with the liquid detergent in the detergent mixing part 186 and then flows into the tub 122 through the water delivery passage 134. Where the detergent mixing 186 is partitioned into plural sections, the washing water is mixed with the liquid detergent for washing laundry and is then introduced into the tub 122.

Upon completion of supplying the washing water and liquid detergent into the tub 122, the driving part 113 rotates the drum 124 for a predetermined time. At this time, the washing water and the liquid detergent are circulated by the circulation pump 136 inside and outside the washing tub.

When the washing process is complete, the driving part 113 stops and the water discharge pump 142 operates to discharge the washing water and liquid detergent used for washing to the outside. Then, when the washing water supply valve 131 opens so that a predetermined amount of washing water is supplied again from the external water source, the washing water is mixed with the liquid detergent for rinsing in the detergent mixing part 186 and introduced into the tub 122. The driving part 113 is initiated to rotate the drum 124 for a predetermined time. Then a rinsing process of the laundry is performed.

Upon completion of the rinsing process, the driving part 113 stops and the water discharge pump 142 operates to discharge the washing water and the liquid detergent to the outside, and then a dehydrating process and a drying process may be performed according to a predetermined setup.

Figure 6:
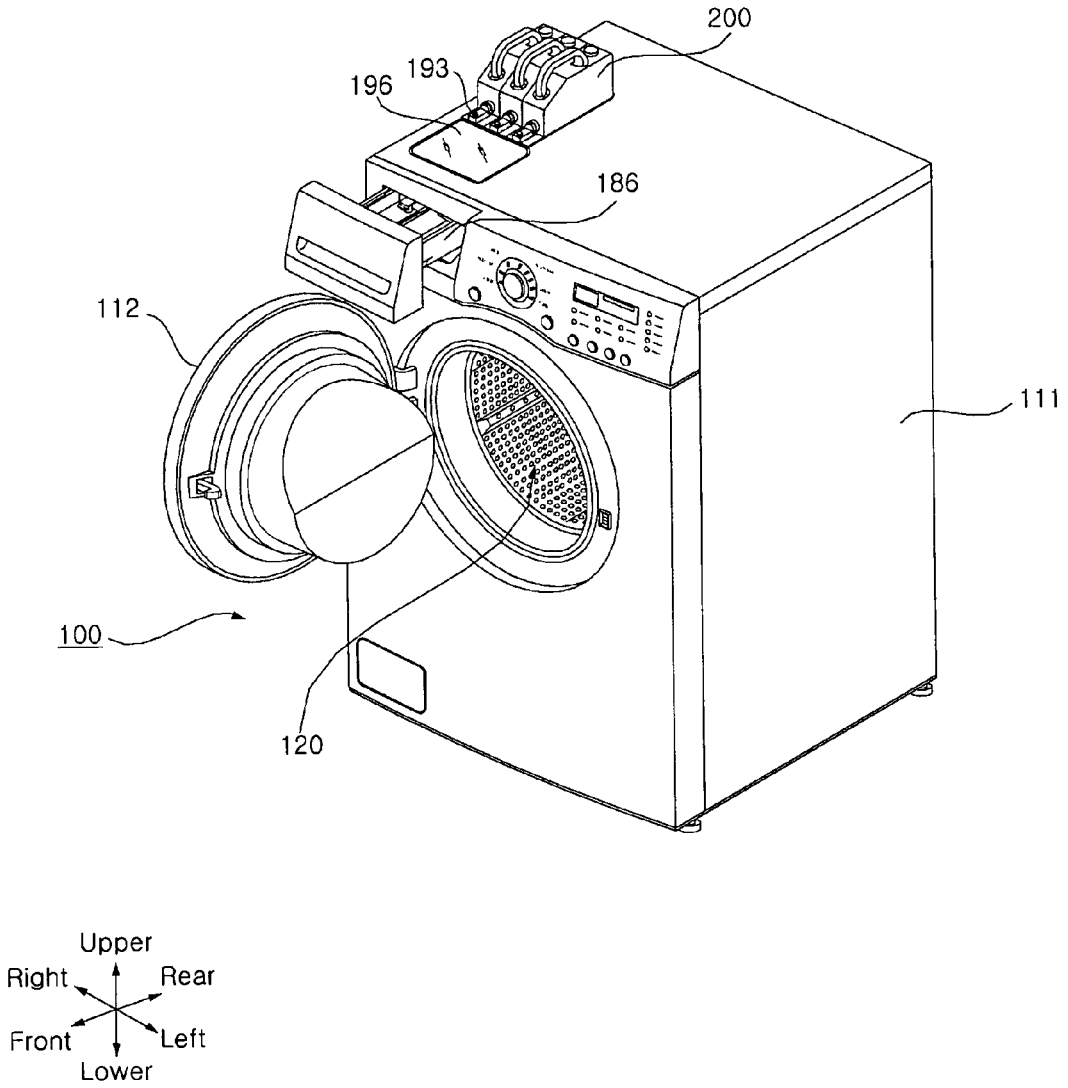
FIG. 6 is a perspective view illustrating a washing machine according to another exemplary embodiment of the invention.
Figure 7:
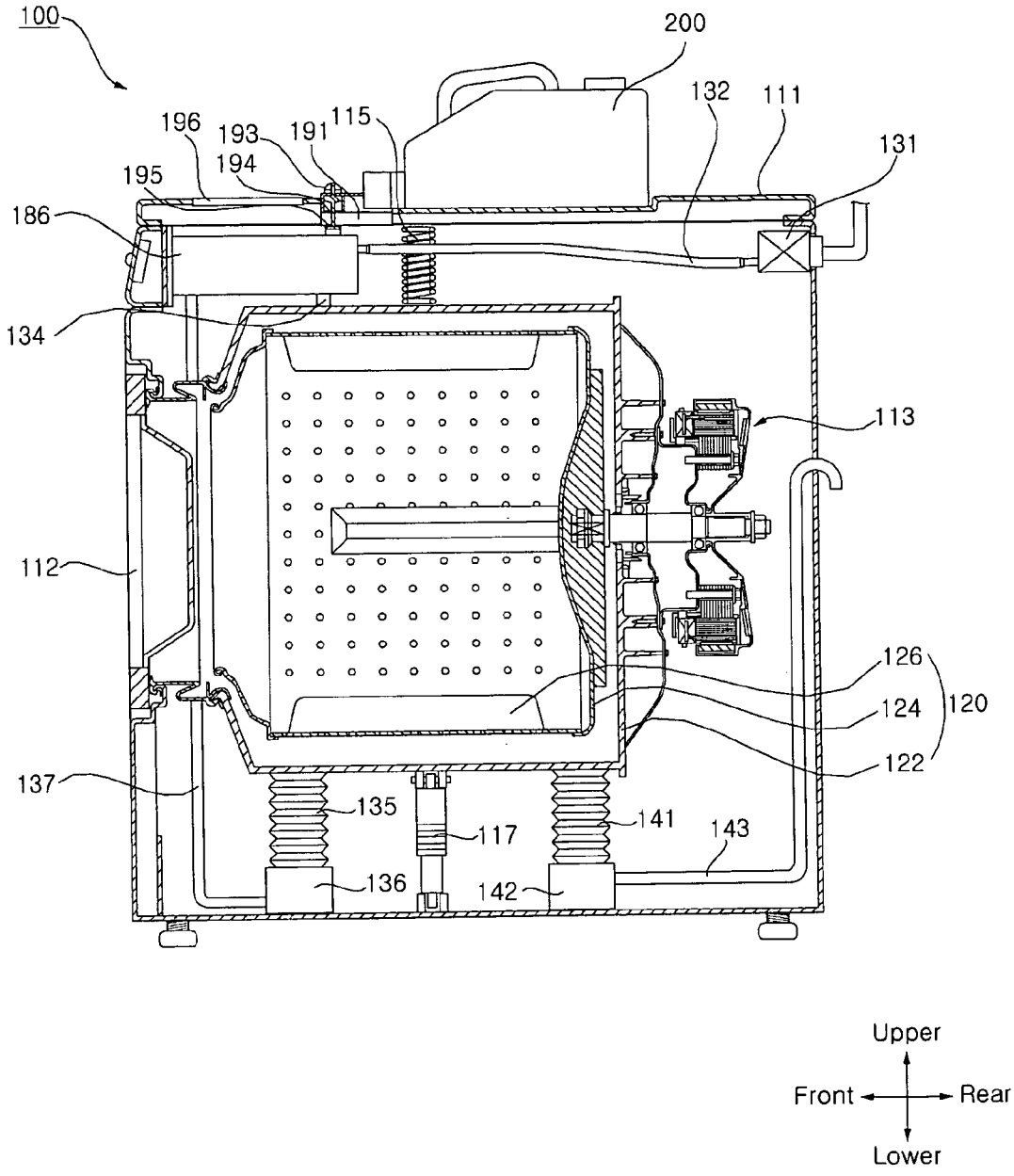
FIG. 7 is a side cross sectional view of the washing machine shown in FIG. 6.

FIG. 6 is a perspective view illustrating a washing machine according to another exemplary embodiment of the invention, and FIG. 7 is a side cross sectional view of the washing machine shown in FIG. 6.

The structure or implementing method of the washing tub 120, the body 111, the detergent bottle seating part 184, the detergent bottle 200, and the detergent mixing part 186 is similar to that described above with reference to the above exemplary embodiment of the invention, and therefore, the detailed description will be omitted.

An auxiliary mixing part 191 is provided between the detergent inlet 194 and the detergent mixing part 186 so that a predetermined amount of liquid detergent from the detergent bottle 200 may be supplied to the detergent mixing part 186. The auxiliary mixing part 191 preferably has a capacity of less than about 150 cc. The auxiliary mixing part 191 has a detergent outlet 195 through which the liquid detergent flows toward the detergent mixing part 186.

The auxiliary mixing part 191 preferably has an indicator 196 that allows a user to check the amount of inflow liquid detergent. The indicator 196 may be implemented in various ways. In the exemplary embodiment of the invention, there may be provided a window on the body 111 so that the stored liquid detergent may be seen from the outside, and the auxiliary mixing part 191 may be implemented with a transparent material. However, the indicator 196 may also take the form of an electronic sensing apparatus since it is enough for the indicator 196 to indicate whether or not the liquid detergent is sufficiently filled in the auxiliary mixing part 191.

The detergent supply button 193 blocks the detergent inlet 194 and opens the detergent outlet 195 during non-operation, and the detergent supply button 193 opens the detergent inlet 194 and blocks the detergent outlet 195 during operation. When the detergent supply button 193 is pressed, the liquid detergent stored in the detergent bottle 200 flows passively by the force of gravity into the auxiliary mixing part 191 through the opened detergent inlet 194. The entering liquid detergent may be stored in the auxiliary detergent storing part 191 as the detergent outlet 195 may be blocked.

When the detergent supply button 193 is pressed the liquid detergent stored in the auxiliary mixing part 191 may exit through the opened detergent outlet 195 into the detergent mixing part 186. The dispensed detergent may not flow back into the auxiliary detergent storing part 191 since the detergent inlet 194 is blocked when supply button 193 is pressed. Accordingly, if the auxiliary detergent storing part 191 has a constant capacity, a predetermined amount of liquid detergent may enter and remain in the detergent mixing part 186 as the detergent supply button 193 is pressed for a predetermined amount of time and then released.

It is noted that in both of the above embodiments the detergent mixing part may be used only for storing and/or measuring the dispensed liquid detergent. In this case, an auxiliary mixing part (not shown) may be provided separately to mix the liquid detergent with water or the like, before introducing the detergent into the tub 120 for washing.

An operation of the washing machine according to the exemplary embodiment of the invention as configured above will be described as follows.

A user places the detergent bottle 200 on the detergent bottle seat 184. If the detergent bottle 200 has been already seated on the detergent bottle seat 184, this process would be omitted.

The user opens the door 112 and puts laundry in the drum 124 of the washing tub 120. When the user presses the detergent supply button 193, the liquid detergent in the detergent bottle 200 may enter and remain in the auxiliary mixing part 191 through the opened detergent inlet 194. The user checks the amount of liquid detergent entered into the auxiliary detergent storing part 191 through the indicator 196. When the liquid detergent is filled in the auxiliary mixing part 191 to satisfaction, the user will press the detergent supply button 193 to dispense the detergent through detergent outlet 195 into the detergent mixing part.

The user may repeatedly press the detergent supply button 193 according to the amount and type of the laundry or the concentration of the detergent to supply the liquid detergent to the detergent mixing part 186 in a constant amount. For example, when the auxiliary mixing part 191 has a capacity of 150 cc and the amount of liquid detergent necessary for washing is 300 cc, the user presses the detergent supply button 193 twice to adjust the amount of the liquid detergent.

In case of plural detergent bottles 200, the user appropriately supplies the liquid detergent for washing, the liquid detergent for rinsing, and the liquid detergent for bleaching to the detergent mixing part 186. The remaining washing processes are substantially identical to that described above with reference to the above exemplary embodiment of the invention.

Figure 8:
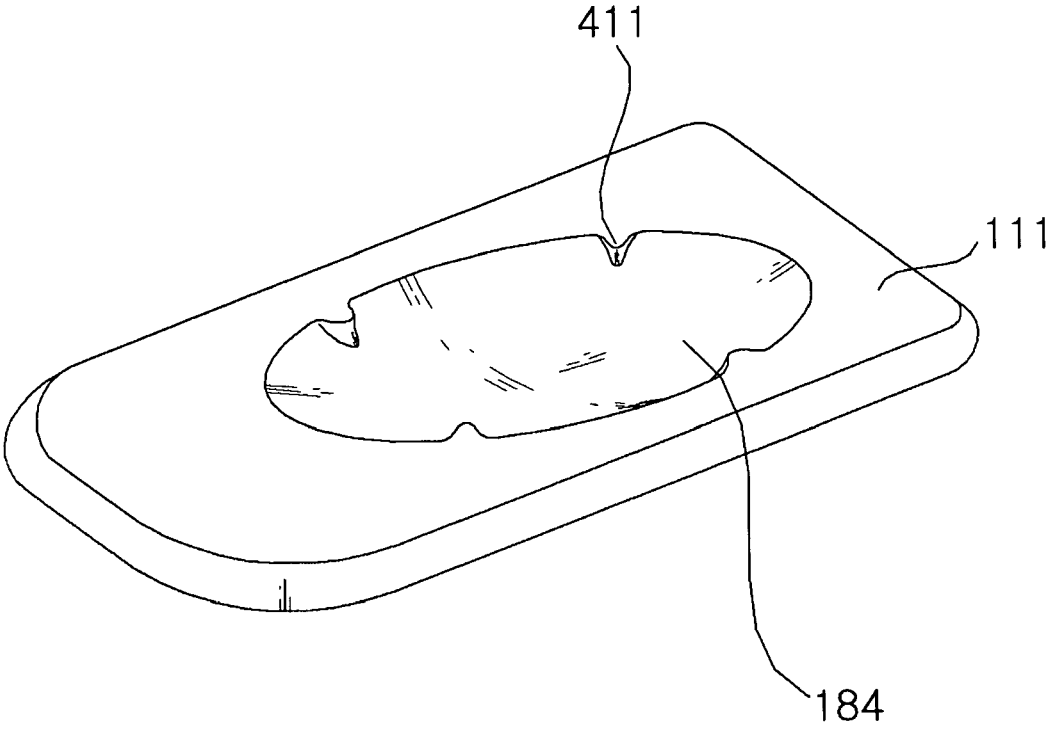
FIG. 8 is a view illustrating a detergent bottle seat included in a washing machine according to still another exemplary embodiment of the invention.

FIG. 8 is a view illustrating the detergent bottle seating part included in the washing machine according to still another exemplary embodiment of the invention.

The detergent mixing part 186 includes a detergent bottle fixing protrusion 411 that fixes the detergent bottle 200. The detergent bottle fixing protrusion 411 may be implemented variously depending on the shape of the detergent bottle 200 so as to be capable of fixing the detergent bottle 200 on the detergent bottle seating part 184.

Figure 9:
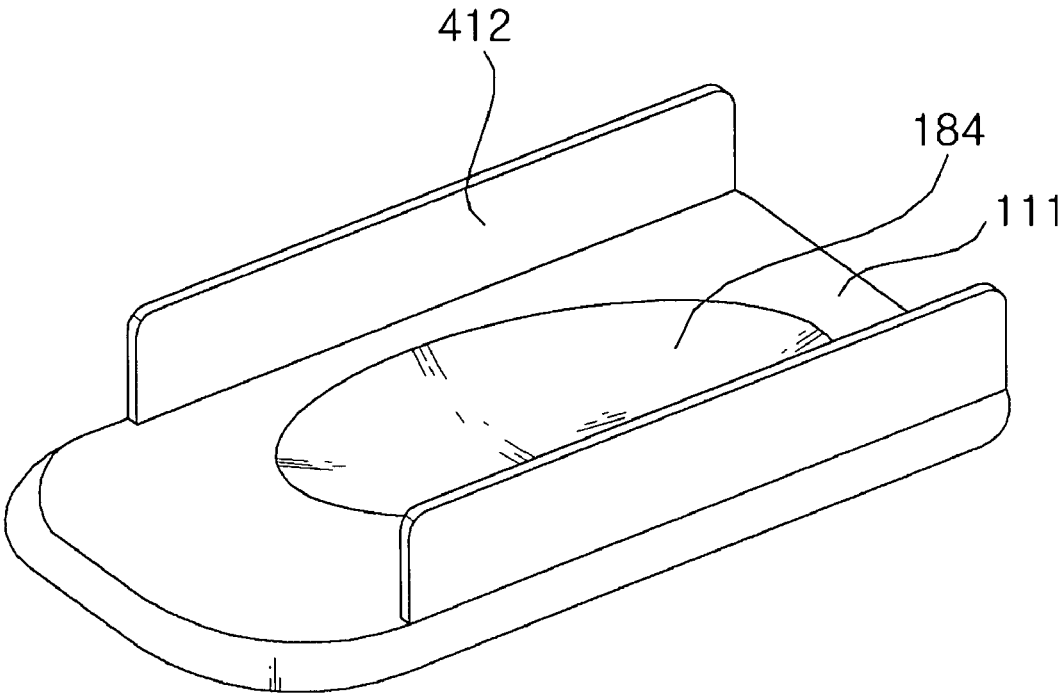
FIG. 9 is a view illustrating a detergent bottle seat included in a washing machine according to yet still another exemplary embodiment of the invention.

FIG. 9 is a view illustrating the detergent bottle seating part 184 included in the washing machine according to yet still another exemplary embodiment of the invention.

The detergent bottle seat 184 includes a detergent bottle supporting part 412 that supports a side surface of the detergent bottle 200. The detergent bottle supporting part 412 may be implemented variously according to the shape of the detergent bottle 200 so as to be capable of supporting the detergent bottle 200.

Even though the washing machine according to the exemplary embodiments of the invention has been described with reference to the accompanying drawings, the exemplary embodiments of the invention are not limited the above exemplary embodiments, and may be modified or varied by those skilled in the art without departing from the spirit and scope of the exemplary embodiments of the invention.

Even though it has been described that the detergent supply apparatus according to the exemplary embodiments of the invention is used for a washing machine, the disclosure is not limited thereto. For example, the detergent supply apparatus may be applied to other washing apparatuses such as a dish washer.

Furthermore, the exemplary embodiments of the invention are not limited to the drum-type washing machine and may be also applied to a pulsator-type or agitator-type washing machine that pours in the liquid detergent.

The foregoing embodiments and advantages are merely exemplary and are not to be construed as limiting the exemplary embodiments of the invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

The invention claimed is:

1. A detergent supply apparatus comprising:

a detergent bottle containing a liquid detergent;

a detergent bottle seat provided at a cabinet in which washing is performed;

a detergent inlet formed at the cabinet such that the liquid detergent of the detergent bottle is entered there through; and a detergent mixing part provided in the cabinet, wherein the liquid detergent of the detergent bottle passing through the detergent inlet is stored and mixed with a washing water therein;

wherein the detergent bottle seat comprises a detergent bottle seating recess formed at an upper surface of the cabinet, wherein the seating recess is an elastic member that is deformable based on a shape of a bottom portion of the detergent bottle such that the bottom portion of the detergent bottle is detachably received and seated therein, and a plurality of detergent bottle fixing protrusions adapted to maintain the detergent bottle in a stationary position, wherein the detergent bottle fixing protrusions are formed around the detergent bottle seating recess.

2. The detergent supply apparatus of claim 1, wherein the detergent bottle seat includes a detergent supply button adapted to open and close the detergent inlet.

3. The detergent supply apparatus of claim 1, wherein the detergent mixing part includes an indicator to monitor the amount of the liquid detergent supplied from the detergent bottle.

4. The detergent supply apparatus of claim 3, wherein the indicator comprises a transparent window and is disposed proximate the detergent mixing part.

5. The detergent supply apparatus of claim 1, wherein the detergent bottle seat is adapted to support a plurality of detergent bottles, the detergent bottle seat including a plurality of detergent inlets corresponding to each of the plurality of detergent bottles, and wherein the detergent mixing part is formed as a single body to receive the liquid detergent from each of the plurality of detergent bottles, the detergent mixing part being partitioned into a plurality of sections corresponding to each of the plurality of detergent inlets adapted to separately store the liquid detergent supplied from the plurality of the detergent bottles respectively.

6. The detergent supply apparatus of claim 5 further comprising:

a flow guide having a plurality of detergent fluid passages adapted to supply each of the liquid detergents contained in the plurality of detergent bottles individually to each of the plurality of sections of the detergent mixing part.

7. The detergent supply apparatus of claim 6, wherein the flow guide includes a detergent supply button adapted to independently open and close the detergent fluid passages.

8. The detergent supply apparatus of claim 1, further comprising:

an auxiliary mixing part provided between the detergent inlet and the detergent mixing part so that a predetermined amount of the liquid detergent stored in the detergent bottle can be supplied into the detergent mixing part, the auxiliary mixing part having a detergent outlet through which the liquid detergent can flow into the detergent mixing part; and a detergent supply button adapted to open the detergent inlet while blocking the detergent outlet during supply of the liquid detergent from the detergent bottle to the auxiliary mixing part, and to block the detergent inlet while opening the detergent outlet during supply of the liquid detergent from the auxiliary mixing part to the detergent mixing part.

9. The detergent supply apparatus of claim 6, further comprising:

an indicator to monitor the amount of the liquid detergent entered into the auxiliary mixing part.

10. The detergent supply apparatus of claim 1, wherein a mouth of the detergent bottle is inserted into the detergent inlet.

11. A washing machine comprising:

a cabinet body having a washing tub therein;

a detergent bottle containing a liquid detergent;

a detergent bottle seat provided at the cabinet;

a detergent inlet formed at the cabinet such that the liquid detergent of the detergent bottle is entered there through: and a detergent mixing part provided in the cabinet, wherein the liquid detergent of the detergent bottle passing through the detergent inlet is stored and mixed with a washing water therein wherein the detergent bottle seat comprises a detergent bottle seating recess formed at an upper surface of the cabinet, wherein the seating recess is an elastic member that is deformable based on a shape of a bottom portion of the detergent bottle such that the bottom portion of the detergent bottle is detachably received and seated therein, and a plurality of detergent bottle fixing protrusions adapted to maintain the detergent bottle in a stationary position, the detergent bottle fixing protrusions are formed around the detergent bottle seating recess.

12. The washing machine of claim 11, wherein the detergent bottle seat includes a detergent supply button adapted to open and close the detergent inlet.

13. The washing machine of claim 11, wherein the detergent mixing part includes an indicator to monitor the amount of the liquid detergent supplied from the detergent bottle.

14. The detergent supply apparatus of claim 13, wherein the indicator comprises a transparent window and is provided proximate the detergent mixing part.

15. The washing machine of claim 11, wherein the detergent bottle seat is adapted to support a plurality of detergent bottles, the detergent bottle seat including a plurality of detergent inlets corresponding to each of the plurality of detergent bottles, and wherein the detergent mixing part is partitioned into a plurality of sections corresponding to each of the plurality of detergent inlets adapted to separately store the liquid detergent supplied from the plurality of the detergent bottles respectively.

16. The detergent supply apparatus of claim 15 further comprising:

a flow guide having a plurality of detergent fluid passages adapted to supply each of the liquid detergents contained in the plurality of detergent bottles individually to each of the plurality of sections of the detergent mixing part.

17. The washing machine of claim 16, wherein the flow guide includes a detergent supply button adapted to independently open and close the detergent fluid passages.

18. The washing machine of claim 11, further comprising:

an auxiliary mixing part provided between the detergent inlet and the detergent mixing part so that a predetermined amount of the liquid detergent stored in the detergent bottle can be supplied into the detergent mixing part, the auxiliary mixing part having a detergent outlet through which the liquid detergent can flow into the detergent mixing part; and a detergent supply button adapted to open the detergent inlet while blocking the detergent outlet during supply of the liquid detergent from the detergent bottle to the auxiliary mixing part, and to block the detergent inlet while opening the detergent outlet during supply of the liquid detergent from the auxiliary mixing part to the detergent mixing part.

19. The washing machine of claim 18, further comprising:

an indicator to monitor the amount of the liquid detergent entered into the auxiliary mixing part.

* * * * *